United States Patent [19]

Oliff

[11] Patent Number: 4,545,485

[45] Date of Patent: Oct. 8, 1985

[54] BOTTLE CARRIER CHIME ENGAGING FLAP STRUCTURE

[75] Inventor: James R. Oliff, Austell, Ga.

[73] Assignee: The Mead Corporation, Dayton, Ohio

[21] Appl. No.: 636,580

[22] Filed: Aug. 1, 1984

[51] Int. Cl.[4] ..... B65D 71/00

[52] U.S. Cl. ..... 206/434; 206/147; 206/427; 229/40

[58] Field of Search ..... 229/40; 206/427, 429, 206/434, 140, 145-161

[56] References Cited

U.S. PATENT DOCUMENTS

| | | | |
|---|---|---|---|
| 3,253,706 | 5/1966 | Spillson | 206/158 |
| 3,373,867 | 3/1968 | Wood | 229/40 X |
| 3,640,448 | 2/1972 | Wood | 206/158 X |
| 3,711,143 | 1/1973 | Smed | 206/158 X |
| 4,437,606 | 3/1984 | Graser | 206/434 X |

FOREIGN PATENT DOCUMENTS

| | | | |
|---|---|---|---|
| 116363 | 3/1969 | Norway | 229/40 |

*Primary Examiner*—William Price
*Assistant Examiner*—Gary E. Elkins
*Attorney, Agent, or Firm*—Rodgers & Rodgers

[57] ABSTRACT

An economical machanically strong article carrier of the wraparound type having top, bottom and side walls interconnected to form a tubular open ended structure wherein said top wall includes a main control panel and a pair of sloping shoulder panels foldably joined to opposite side edges of the main central panel is provided with apertures formed in said top wall for receiving the necks of packaged bottles, certain apertures being defined by two web structures together with two abutment tabs foldably joined to said main central panel along fold lines which are disposed in substantially normal relation to each other and are arranged at approximately 45° to the longitudinal axis of the carrier.

5 Claims, 4 Drawing Figures

BOTTLE CARRIER CHIME ENGAGING FLAP STRUCTURE

TECHNICAL FIELD

This invention relates to article carriers of the wraparound neck through type and is concerned with improved article retention structure associated with the necks of the packaged articles. While the invention relates primarily to bottle groups it is also applicable to other containers having tapered necks.

BACKGROUND ART

U.S. Pat. No. 3,640,448 issued Feb. 8, 1972 and owned by the assignee of this invention discloses an article carrier of the wraparound type for two rows of bottles and which is provided with neck through apertures and associated web structure and tabs which cooperate to hold the bottles in one row in spaced relation to the bottles in the other row. The wrapper of this patent is secured about the packaged bottles so as to maintain substantial tension in the wrapper.

DISCLOSURE OF THE INVENTION

According to this invention in one form an improved article carrier of the neck through wrap around type is provided in which the tension of the wrapper is substantially less than the tension of many wrappers of the prior art and in which the neck receiving apertures are defined by web structure and by a pair of abutment tabs foldably joined to the wrapper main central panel along fold lines which are disposed in substantially normal relation to each other and at approximately 45° to the longitudinal axis of the carrier and which are substantially vertically disposed with their upper ends in close proximity with caps of the associated articles. Arcuate slits form continuations of the adjacent ends of the abutment tab fold lines and the adjacent edges of the abutment tabs are separated by a slit which is transverse to the longitudinal axis of the carrier.

BRIEF DESCRIPTION OF THE DRAWINGS

In the drawings

FIG. 3 is a detailed fragmentary view taken along the line designated 3—3 in FIG. 1 and in which

BEST MODE OF CARRYING OUT THE INVENTION

Figure 2:
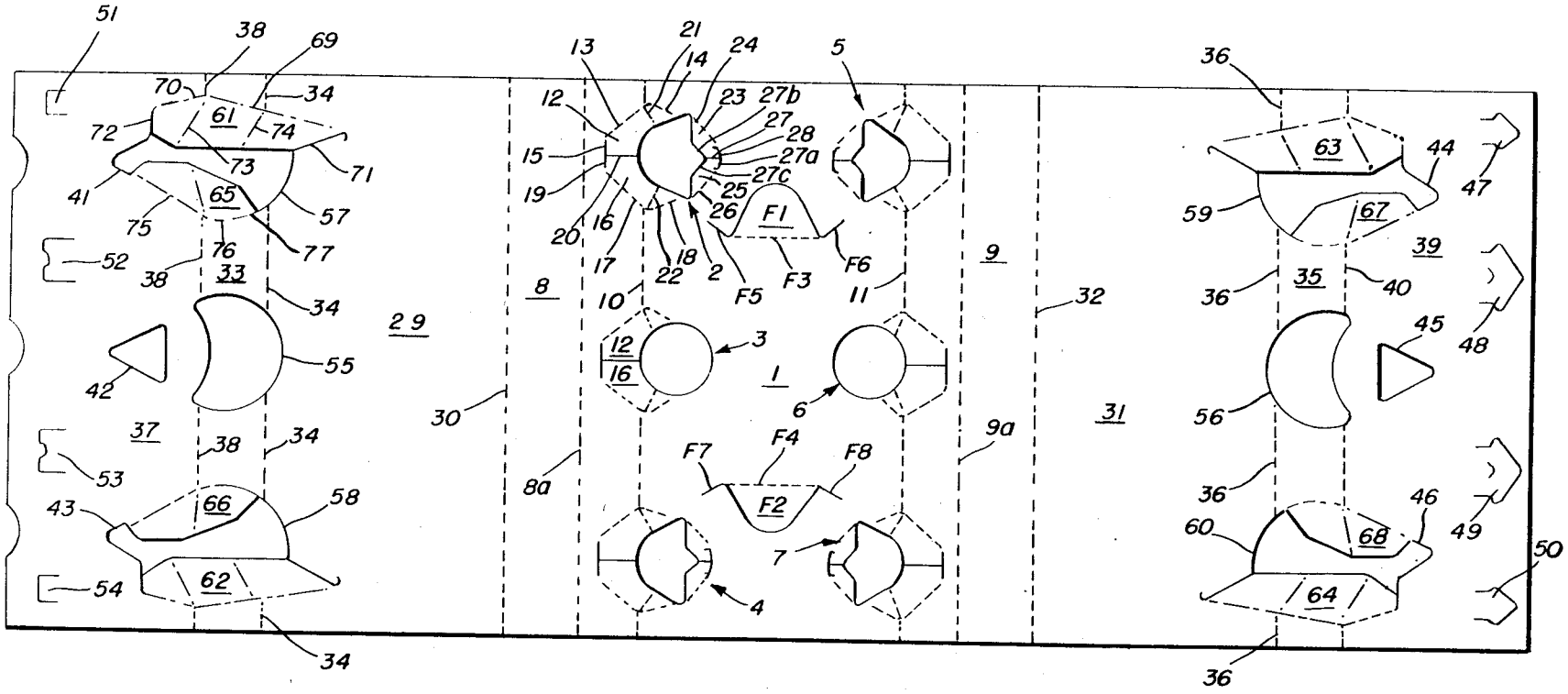
FIG. 2 is a plan view of a blank from which the carrier of FIG. 1 is formed.

The carrier blank as shown in FIG. 2 includes a top wall generally designated by the numeral 1 in which bottle neck receiving apertures 2–7 are formed. These apertures may extend somewhat into the sloping shoulder panels 8 and 9 which are foldably joined to the side edges of top wall 1 along fold lines 10 and 11 respectively. Fold lines 8*a* and 9*a* may be formed in sloping panels 8 and 9 respectively to adapt the wrapper to certain bottle shapes.

Finger gripping tabs F1 and F2 are struck from top wall 1 and are foldably joined thereto along fold lines F3 and F4 respectively. Slits F5 and F6 are angularly related to fold lines F3 and slits F7 and F8 are similarly disposed relative to fold line F4.

Certain bottle neck engaging flaps are associated with the neck receiving apertures 2–7 as shown in FIG. 2. The flaps associated with apertures 2, 4, 5, and 7 are identical and for this reason the flaps associated with aperture 2 only are here described.

Web structure 12 is foldably joined along fold line 13 to sloping shoulder panel 8 and to top wall 1 along fold line 14. Fold lines 13 and 14 intersect at fold line 10 by which sloping shoulder panel 8 is foldably joined to top wall 1. A slit 15 separates one end of web structure 12 from sloping shoulder panel 8 as is indicated. Web structure 16 is complementary to web structure 12 and includes fold lines 17 and 18 which intersect at fold line 10 and slit 19 separates an end of web structure 16 as indicated from sloping shoulder panel 8. Slits 15 and 19 are formed in sloping shoulder panel 8 and facilitate upward folding of web structures 12 and 16 and limit the length of slit 20 which would tend to impede such upward folding if it extended below line 8*a*. Web structures 12 and 16 are separated from each other by a transverse slit 20. Fold lines 21 and 22 facilitate bending of web structures 12 and 16 so as to facilitate engagement with the associated bottle neck.

On the other side of aperture 2 an abutment tab 23 is foldably joined to top wall 1 along fold line 24 while an abutment tab 25 is foldably joined to top wall 1 along fold line 26. Fold lines 24 and 26 are disposed in substantially normal relation to each other and are arranged at approximately 45° to the longitudinal axis of the carrier. Tabs 23 and 25 are separated from each other along slit 27 one end of which coincides with arcuate slit 27*a* and the other end of which coincides with the intersection of angularly related edges 27*b* and 27*c* which form a V-shaped notch which edges are herein considered as upper edges of the abutment tabs in a set up and loaded carrier. Slit 27 is transverse to the longitudinal axis of the carrier. Arcuate slit 27*a* forms a continuation of adjacent ends of fold lines 24 and 26.

Figure 1:
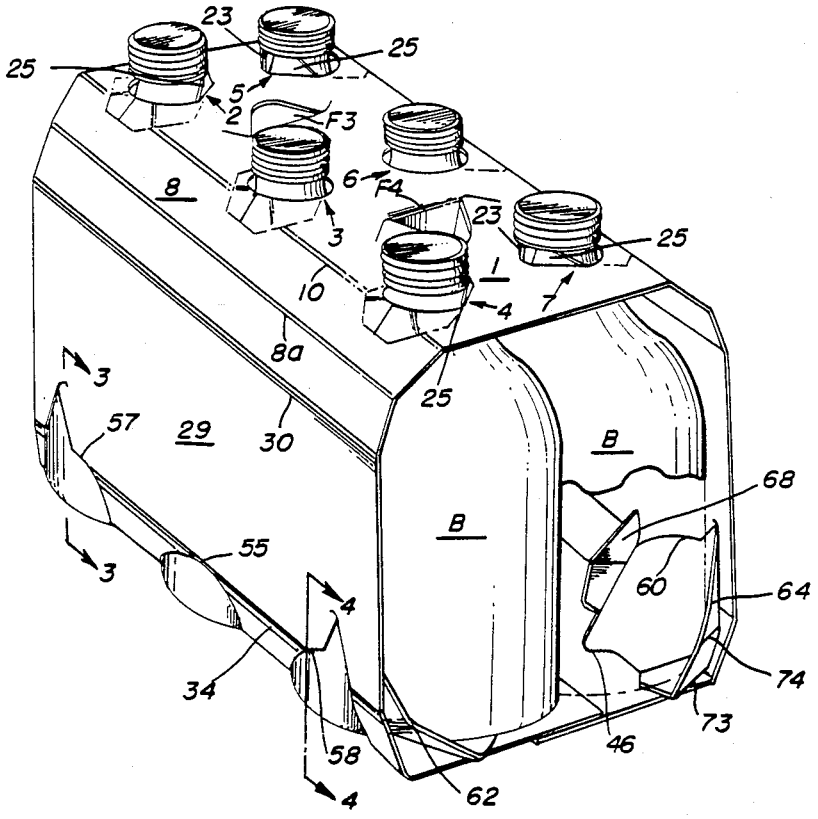
FIG. 1 is a perspective view of a set up carrier in which bottles B are disposed and which incorporates features of this invention.
Figure 4:
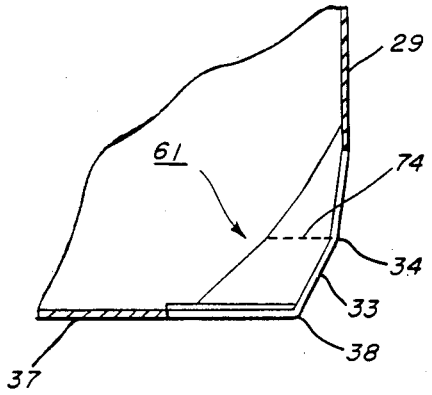
FIG. 4 is an enlarged fragmentary view taken along the line 4—4 in FIG. 1.
Figure 3:
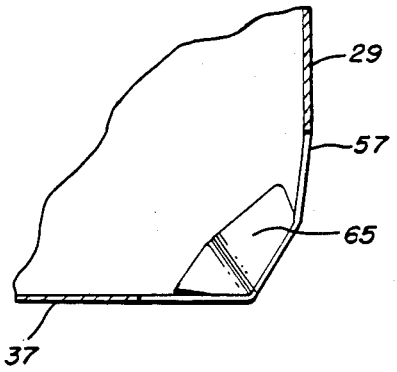

As is apparent from FIG. 1 the abutment tabs such as 23 and 25 are substantially vertical and their upper edges are in close proximity to the caps of the associated bottles since the wrapper is loose the bottles may ride upwardly but are securely retained against dislodgment.

The end bottles are restrained from movement out of their normal or perpendicular relation to the main central panel 1 in part because of the engagement between each bottle neck and the associated fold lines 24 and 26. Since the main central panel is horizontal and the abutment tabs 23 and 25 are vertical, the part of the carrier along fold lines 24 and 26 is quite rigid and affords a firm barrier against bottle movement either inwardly or outwardly of the wrapper tube.

As is obvious from FIG. 2 web structures 12 and 16 are provided for aperture 3 but the small complementary abutment tabs 23 and 25 are eliminated from bottle neck receiving apertures 3 and 6.

Side wall 29 is foldably joined to sloping shoulder panel 8 along fold line 30 while side wall 31 is foldably joined to sloping shoulder panel 9 along fold line 32.

Sloping heel panel 33 is foldably joined to the bottom edge of side wall 29 along interrupted fold line 34 while sloping heel panel 35 is foldably joined to the bottom edge of side wall 31 along interrupted fold line 36.

Bottom lap panel 37 is foldably joined to the bottom edge of sloping heel panel 33 along interrupted fold line 38 while bottom lap panel 39 is foldably joined to the bottom edge of sloping heel panel 35 along interrupted fold line 40.

For tightening the wrapper about a group of articles, tightening apertures 41, 42 and 43 are formed in lap panel 37 while similar tightening apertures 44, 45 and 46 are formed in lap panel 39. With the wrapper disposed about a group of articles and with the lap panels 37 and 39 disposed in overlapping relationship, machine elements enter the tightening apertures and move toward each other so as to tighten the wrapper about the group of articles as is well known.

After the wrapper is tightened, it is locked by means of locking tabs 47–50 which are driven through the apertures defined by retaining tabs 51–54 respectively. The configurations of the locking and retaining tabs are well known and the locking operation is well understood.

Conventional bottle heel receiving apertures 55 and 56 are disposed astride the heel sloping panels 33 and 35 respectively as shown in FIG. 2.

Bottle heel receiving apertures 57 and 58 are disposed astride the sloping heel panel 33 and extend into adjacent portions of side wall 29 and of lap panel 37 as is shown in FIG. 2. The tightening aperture 41 constitutes an extension of bottle heel receiving aperture 57 while tightening aperture 43 constitutes an extension of bottle heel receiving aperture 58.

In like fashion bottle heel receiving aperture 59 as well as bottle heel receiving aperture 60 are disposed astride the sloping heel panel 35 and extend into the lower portions of side wall 31 and into the adjacent portions of lap panel 39. Tightening aperture 44 constitutes an extension of bottle heel receiving aperture 59 while tightening aperture 46 constitutes an extension of bottle heel receiving aperture 60.

Bottle engaging carrier reinforcing flaps 61–68 are formed astride heel panels 33 and 35. Flaps 61–64 are identical and a detailed description of flap 61 only is here included. Similarly flaps 65–68 are identical and a description of flap 65 only is herein included.

Bottle engaging carrier reinforcing flap 61 is foldably joined to the carrier along fold lines 69 and 70 which are angularly related and which intersect at fold line 38. A slit 71 separates one end of flap 61 from side wall 29 while a slit 72 separates the other end of flap 61 from lap panel 37.

For facilitating manipulation of the wrapper about an article group and to enhance the cooperation of the flap 61 with the associated bottle, a fold line 73 is formed in flap 61 one end of which coincides with the fold line 38. Similarly a fold line 74 is formed in flap 61 and is disposed in substantially parallel relation with the fold line 73 although these lines may not be precisely parallel with each other.

When the carrier is assembled with the flap 61 in engagement with an associated bottle, the fold line 73 is disposed adjacent to and lies in a plane which is in substantially parallel relation with the lap panel 37.

Bottle engaging and carrier reinforcing flap 65 is foldably joined to lap panel 37 along fold line 75 and to sloping heel panel 33 along fold line 76. A slit 77 separates a curved end portion of flap 65 from sloping heel panel 33.

The bottle engaging and carrier reinforcing flaps such as are shown associated with bottle heel receiving apertures 2, 4, 5 and 7 are disclosed and claimed in U.S. patent application Ser. No. 636,579 filed Aug. 1, 1984.

In order to form a package such as is shown in FIG. 1 from the blank such as is shown in FIG. 2, a blank is simply lowered from above onto the package in such manner that the bottle necks enter the bottle neck receiving apertures 2–7. Thereafter the side walls 29 and 31 and the associated sloping shoulder panels 8 and 9 and lap panels 37–39 are folded downwardly. Suitable machine elements enter the apertures 57–60 and manipulate the flaps 61–69 inwardly of the wrapper and so as to provide space between each pair of flaps such as 61 and 65 for receiving the heels of adjacent bottles as the side walls 29 and 31 are folded into close proximity with the bottle group and so as to cause the lap panel 37 to swing under the bottle group. Simultaneously the lap panel 39 is folded underneath lap panel 37. Thereafter the blank is tightened and locked as previously explained.

The bottle engaging carton reinforcing flaps 61–68 are manipulated by machine elements such as described in U.S. patent application Ser. No. 636,830 filed Aug. 1, 1984. Also the carton is manipulated from a hopper onto the package so as to cause the bottle neck receiving apertures 2–7 to envelop the bottle necks by suitable mechanism disclosed and claimed in U.S. patent application Ser. No. 636,831 filed Aug. 1, 1984.

INDUSTRIAL APPLICABILITY

This invention is particularly well suited for packaging bottles in a wraparound carrier primarily because it provides a loose but secure package and which enhances economy in the use of material because material such as paperboard may be used which is of lighter weight than that which is required for tight wrappers such as are presently known.

I claim:

1. An article carrier for packaging two rows of bottles and comprising top, bottom, and spaced side walls interconnected to form a tubular structure, said top wall including a main central panel and a pair of sloping shoulder panels foldably adjoined to opposite side edges of said main central panel, a plurality of apertures formed in said top wall for respectively receiving therethrough the necks of packaged bottles, an edge portion of certain of said apertures being defined by two web structures each of which is formed partially in said adjacent sloping panel and partially in said main central panel, said web structures being separated by a transverse slit in said adjacent sloping panel and a pair of abutment tabs defining the remaining edge portion of the apertures with which said web structures are associated, said abutment tabs being separated from each other by a transverse slit one end of which coincides with the intersection of angularly related upper edges of said abutment tabs which edges define a V-shaped notch and said abutment tabs being foldably joined to said main central panel along individual fold lines which are disposed in substantially normal relation to each other and at approximately 45° to the longitudinal axis of said main central panel thereby to engage the associated bottle neck to tend to hold the associated bottle in normal relation to said main central panel and to prevent substantial movement of the heel of the associated bottle outwardly or inwardly of the open ended carrier.

2. An article carrier according to claim 1 wherein said abutment tabs are substantially vertically disposed with their upper edges in close proximity with the caps of the associated bottles respectively.

3. An article carrier for packaging two rows of bottles and comprising top, bottom, and spaced side walls interconnected to form a tubular structure, said top wall including a main central panel and a pair of sloping shoulder panels foldably adjoined to opposite side edges of said main central panel, a plurality of apertures formed in said top wall for respectively receiving therethrough the necks of packaged bottles, an edge portion of certain of said apertures being defined by two web structures each of which is formed partially in said adjacent sloping panel and partially in said main central panel, said web structures being separated by a transverse slit in said adjacent sloping panel and a pair of abutment tabs defining the remaining edge portion of the apertures with which said web structures are associated, said abutment tabs being foldably joined to said main central panel along individual fold lines which are disposed in substantially normal relation to each other and at approximately 45° to the longitudinal axis of said main central panel thereby to engage the associated bottle neck to tend to hold the associated bottle in normal relation to said main central panel and to prevent substantial movement of the heel of the associated bottle outwardly or inwardly of the open ended carrier and the abutment tabs of each pair being separated from each other by a slit in said main central panel which is transverse to the longitudinal axis of the carrier, and an arcuate slit in said main central panel forming a continuation of one end of each of said individual fold lines.

4. An article carrier according to claim 3 wherein said arcuate slits are interconnected at adjacent ends and wherein one end of the slit which is transverse to the longitudinal axis of the carrier intersects the interconnected ends of said arcuate slits.

5. An article carrier for packaging two rows of bottles and comprising top, bottom, and spaced side walls interconnected to form a tubular structure, said top wall including a main central panel and a pair of sloping shoulder panels foldably adjoined to opposite side edges of said main central panel, a plurality of apertures formed in said top wall for respectively receiving therethrough the necks of packaged bottles, an edge portion of certain of said apertures being defined by two web structures each of which is formed partially in said adjacent sloping panel and partially in said main central panel, said web structures being separated by a transverse slit in said adjacent sloping panel and a pair of abutment tabs defining the remaining edge portion of the apertures with which said web structures are associated, said abutment tabs being foldably joined to said main central panel along individual fold lines which are disposed in substantially normal relation to each other and at approximately 45° to the longitudinal axis of said main central panel thereby to engage the associated bottle neck to tend to hold the associated bottle in normal relation to said main central panel and to prevent substantial movement of the heel of the associated bottle outwardly or inwardly of the open ended carrier, and a longitudinal slit formed in each sloping shoulder panel and arranged to interconnect said transverse slit by which said web structures are separated thereby to facilitate upward folding of said web structures.

* * * * *